US007345415B2

(12) United States Patent
Chen et al.

(10) Patent No.: US 7,345,415 B2
(45) Date of Patent: Mar. 18, 2008

(54) ARRAY-LIKE FLAT LIGHTING SOURCE

(75) Inventors: Shih Pu Chen, Hsinchu County (TW); Yi Ping Lin, Hsinchu County (TW); Jau Chyn Huang, Hsinchu County (TW); Ching Sung Hsiao, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 346 days.

(21) Appl. No.: 11/012,337

(22) Filed: Dec. 16, 2004

(65) Prior Publication Data

US 2006/0066214 A1 Mar. 30, 2006

(30) Foreign Application Priority Data

Sep. 24, 2004 (TW) ..... 93129030 A

(51) Int. Cl.
*H01J 29/04* (2006.01)

(52) U.S. Cl. ..... 313/495; 313/309; 313/336; 315/169.4

(58) Field of Classification Search ..... 313/495, 313/497, 309–311, 336, 351; 315/169.4
See application file for complete search history.

(56) References Cited

U.S. PATENT DOCUMENTS

| | | | | |
|---|---|---|---|---|
| 5,053,673 | A * | 10/1991 | Tomii et al. | 313/308 |
| 5,977,703 | A * | 11/1999 | Ju et al. | 313/495 |
| 6,940,219 | B2 * | 9/2005 | Russ et al. | 313/495 |
| 2006/0108906 | A1 * | 5/2006 | Gosain et al. | 313/309 |

* cited by examiner

*Primary Examiner*—Ashok Patel
(74) *Attorney, Agent, or Firm*—Bacon & Thomas, PLLC

(57) ABSTRACT

The present invention provides an array-like flat lighting source, which has an array of field emitter elements. The structure of the array of field emitter elements includes a substrate and a plurality of field emitter elements. The substrate has a plurality of grooves formed thereon and each of the field emitter elements is disposed in one of the grooves. The present field emission lighting source is spacer free, and its upper and lower substrates can be made of a same material to facilitate the maintenance of the vacuum. The array of field emitter elements can have an auxiliary conductive line for repair to guarantee normal operation of the light source if one of electrode lines becomes open.

12 Claims, 6 Drawing Sheets

ARRAY-LIKE FLAT LIGHTING SOURCE

BACKGROUND OF THE INVENTION

1. Field of the Invention

The present invention relates to an array-like flat lighting source, and more particularly to a light source with an array of field emitter elements.

2. Description of the Related Art

Carbon nanotube, discovered in 1991, has a superior field emission characteristic than traditional field emitters employing tungsten. Cathode material made of carbon nanotubes have been utilized to fabricate carbon nanotube field emission elements and carbon nanotube field emission displays. If the emission efficiency of the carbon nanotube field emission element can be improved up to 80-100 lm/W, it would become commonly used instead of the fluorescent lamp. FIG. 1 is a schematic cross-sectional view of a conventional flat lighting source employing carbon nanotube field emitters, which includes: a cathode substrate 100; an anode substrate 600 stacked over the cathode substrate 100; a spacer 500 disposed between the cathode substrate 100 and anode substrate 600 to maintain a certain vertical distance and vacuum there between. The cathode substrate 100 is a glass substrate, and a cathode electrode layer 200 is formed thereon. A catalyst layer 300 is formed on the cathode electrode layer 200 to facilitate the growth of the carbon nanotubes. Several carbon nanotubes 400 are formed on the catalyst layer 300 to serve as the cathode field emitters. The anode substrate 600 is a glass substrate, and an anode electrode layer of indium tin oxide (ITO) 700 is formed under the anode substrate 600. A fluorescence layer 800 is formed under the anode electrode layer of indium tin oxide 700. The carbon nanotubes 400 inject electrons under attraction of a voltage of the anode electrode layer of ITO 700, and impinge upon the fluorescence layer 800 to excite the fluorescence layer 800 to emit light passing through the anode substrate 600 to form a flat lighting source.

The above flat lighting source employing the carbon nanotubes as the field emitters has several disadvantages. The carbon nanotubes surrounding the periphery of the electron-emitting area have an edge effect, which makes the peripheral brightness of the fluorescence layer 800 larger than its central brightness, and causes uneven brightness of the above flat lighting source. The illumination characteristic of the flat lighting source is lowered. Moreover, the carbon nanotube 400 is made by arc discharge or laser ablation. However, the above two methods are not suitable for low cost manufacture of the carbon nanocarbon tubes. It is also difficult to control the structure of the carbon nanotubes and is thus difficult to produce a large flat lighting source.

Accordingly, it is an intention to provide an improved flat lighting source with field emission characteristic, which can overcome the above drawbacks.

SUMMARY OF THE INVENTION

One objective of the present invention is to provide an array-like flat lighting source with field emission characteristics, in which field emitter elements can be disposed in any desired array arrangement to improve illuminating uniformity.

Another objective of the present invention is to provide an array-like flat lighting source with field emission characteristics, in which multiple sets of field emitter elements are combined so as to overcome the difficulty in fabricating a large lighting source.

A further objective of the present invention is to provide an array-like flat lighting source with field emission characteristics, which is spacer free and able to maintain a good vacuum inside the lighting source after finishing the packaging of the lighting source assemblies.

Still another objective of the present invention is to provide an array-like flat lighting source with field emission characteristics, in which the field emitter elements have auxiliary conductive lines for repair so that when one of the electrode lines becomes open, the field emitter elements can still operate, and thus increase manufacturing yields for the present lighting source and its operational life.

In order to attain the above objectives, the present invention provides an array-like flat lighting source, which includes: a substrate having an array of grooves formed thereon, which substrate is used as a cathode substrate; a plurality of field emitter elements, each of which is disposed in one of the grooves, and each of the field emitter elements is coupled to a first voltage source; a transparent substrate having a top surface and a bottom surface, where the transparent substrate is stacked on the substrate to form a closed space there between, and the transparent substrate is used as an anode substrate; a transparent conductive layer formed on the bottom surface of the transparent substrate, the transparent conductive layer is coupled to a second voltage source having a voltage higher than the first voltage source; and an emitting layer formed under the transparent conductive layer. The field emitter elements inject electrons under attraction of the second voltage source to impinge upon the emitting layer, and cause the emitting layer to emit light passing through the transparent substrate to form a flat lighting source.

The cathode substrate and anode substrate of the present array-like flat lighting source is mated with each other. As such, a closed space is formed there between when assembling the cathode substrate and anode substrate. Additionally, it is not necessary to provide a spacer between the cathode substrate and anode substrate. Thus, there is no problem concerning the thermal expansion coefficient of the spacer when packaging the lighting source assemblies and the packaging process of the present lighting source assemblies is simplified. Moreover, the cathode substrate and anode substrate can be made of the same material so that both have the same thermal expansion coefficient, which facilitates the maintenance of a vacuum inside the lighting source after packaging of the lighting source assemblies is completed.

In another aspect, the present invention provides a structure of an array of field emitters, which includes a substrate having an array of grooves formed thereon; and a plurality of field emitter elements each of which is disposed in one of the grooves, and each of the field emitter elements is coupled to a first voltage source.

The present invention can provide a structure of field emitters in a desired array arrangement according to the demand for brightness of an illumination application. The field emitter elements and the substrate are separately fabricated, and then combined to form the array of the field emitter elements. The array of field emitter elements of the present invention can facilitate the manufacturing of the large-sized lighting source.

BRIEF DESCRIPTION OF THE DRAWINGS

These and other features, aspects and advantages of the present invention will be better understood with regard to the following description, appended claims and accompanying drawings that are provided only for further elaboration without limiting or restricting the present invention, where:

DETAILED DESCRIPTION OF THE PREFERRED EMBODIMENTS

The present invention provides an array-like flat lighting source suitable for current illuminators, a backlight of a display and a flash device of a camera. The present array-like flat lighting source provides advantages such as lower power consumption, short response time, high illumination efficiency and environmental protection (no mercury), and can provide an alternative commercial lighting source. More specifically, the present invention provides an array-like flat lighting source with field emission characteristics, in which either of the cathode substrate and anode substrate has a U-shaped body such that a closed space is formed between the cathode substrate and anode substrate during assembly. In other words, when the lighting source assemblies are vacuum-packaged, it is not necessary to provide a spacer between the cathode substrate and anode substrate and thus there is no problem of thermal expansion coefficient in connection with the spacer. The packaging process is simplified and the cost is reduced. Moreover, the cathode substrate and anode substrate can be made from same material. Owing to the same thermal expansion coefficient of the cathode substrate and anode substrate, a good vacuum inside the lighting source can be maintained after packaging of the lighting source assemblies is completed. The field emitters of the cathode substrate are disposed in an array structure. Each of the field emitters is made of a laminate or bar-shaped electrode coated with a carbon material. The laminate or bar-shaped electrode is made of a laminate or bar-shaped conductive material. The field emitters are disposed on array-like grooves of the cathode substrate to form the array of the field emitters structure. Additionally, the density of the cathode field emitters can be varied according to the different demands for brightness. The field emitters associated with electrodes are serially connected together and have auxiliary conductive lines for repair. When one of the electrode lines becomes open, the field emitters guarantee a continual normal state of operation.

In the present invention, the cathode field emitters, an upper substrate and a lower substrate are separately manufactured. When all the components are prepared, the assembling process for the present lighting source is completed. Thus, the step of coating the carbon material on the cathode electrode is not influenced by factors such as temperature during the manufacturing process of the field emitters. The manufacturing process is simplified and cost is reduced.

The structure of the array of field emitters and the array-like flat lighting source with the array of the field emitters is described in detail according to following preferred embodiments with reference to accompanying drawings.

Figure 1:
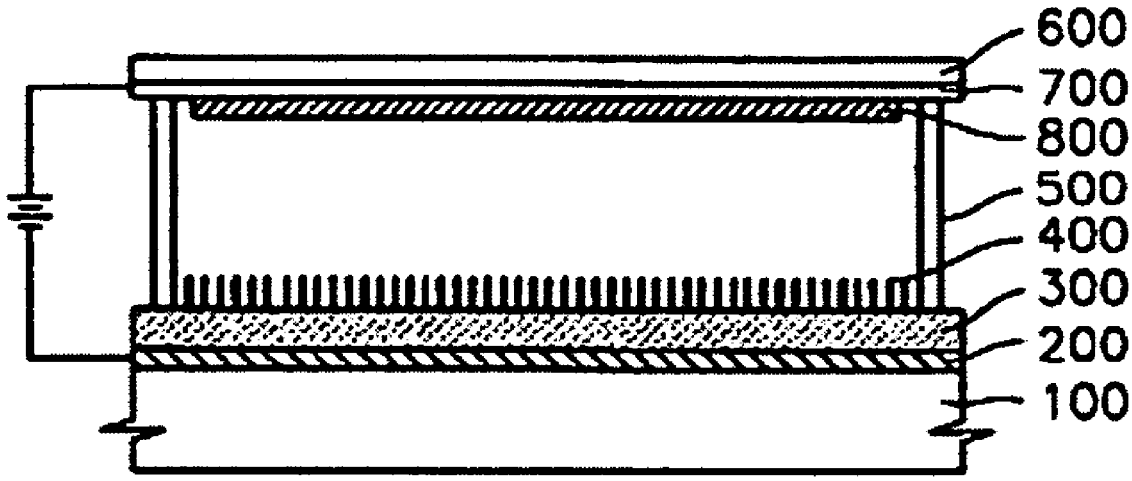
Fig.1 (Prior Art)
FIG. 1 is a schematic cross-sectional view of a conventional flat lighting source employing carbon nanotube field emitters.
Figure 2A:
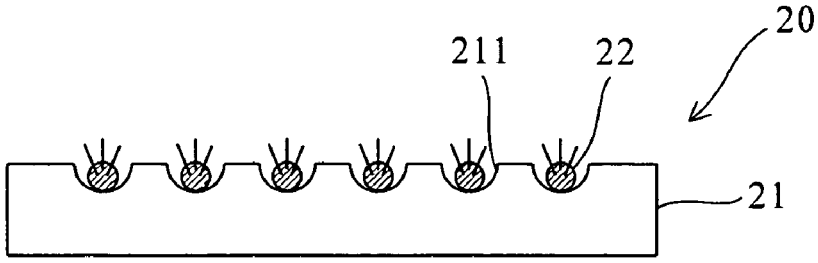
FIG. 2A is a schematic cross-sectional view of an array of field emitters according to a first preferred embodiment of the present invention.
Figure 2B:
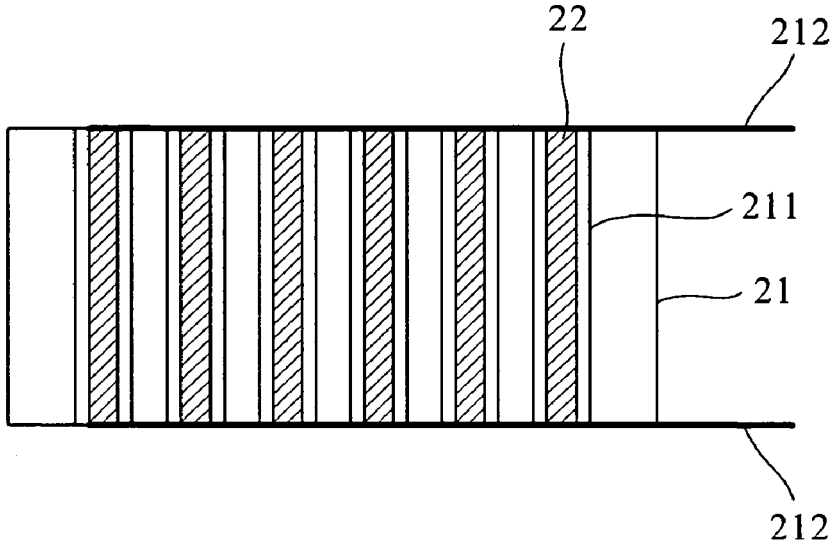
FIG. 2B is a schematic top view of the array of field emitters of FIG. 2A.

FIG. 2A is a schematic cross-sectional view of the array of the field emitters 20 according to a first preferred embodiment of the present invention. The array of field emitters 20 is a diode structure that includes: a substrate 21 used for a cathode substrate with an array of grooves 211 formed thereon, the substrate 21 can be made of a glass substrate, a plastic substrate or other suitable material, and the groove 211 can have an arc-shaped or U-shaped cross section; a plurality of field emitter elements 22 each of which is disposed in one of the grooves 211, the field emitter elements 22 can be made of laminate, bar-shaped or column-shaped conductive material coated by carbon material. The carbon material can be selected from the materials such as nanocarbons, diamonds or diamond-like materials. The cathode electrodes are made of the laminate, bar-shaped or column-shaped conductive material. FIG. 2B is a schematic top view of the array of the field emitters 20, the field emitter elements 22 are serially connected together by electrode lines 212, and then coupled to a first voltage source (not shown).

Figure 2C:
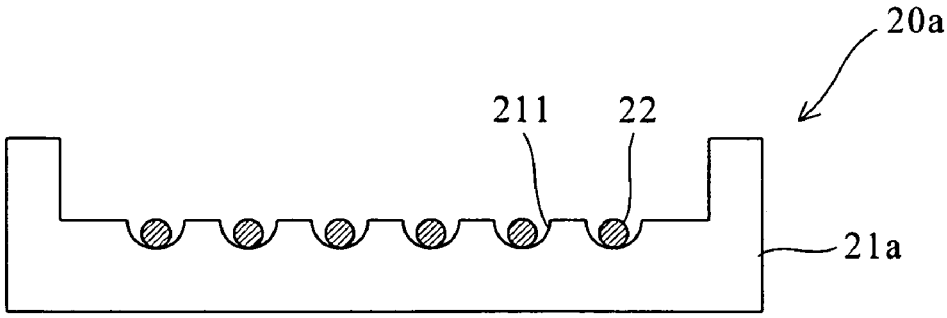
FIG. 2C is a schematic cross-sectional view of a variance of the array of field emitters of FIG. 2A.

FIG. 2C is a schematic cross-sectional view of a variance 20*a* of the array of the field emitters 20 of FIG. 2A. The difference between FIG. 2C and FIG. 2A resides in that a substrate 21*a* of FIG. 2C has a U-shaped body that is formed by a physical etching or chemical etching or a molding method.

Figure 3A:
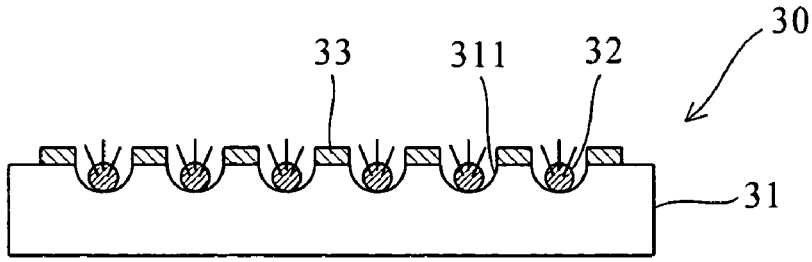
FIG. 3A is a schematic cross-sectional view of an array of field emitters according to a second preferred embodiment of the present invention.

FIG. 3A is a schematic cross-sectional view of an array of field emitters 30 according to a second preferred embodiment of the present invention. The array of the field emitters 30 is a triode structure that includes: a substrate 31 used for a cathode substrate with an array of grooves 311 formed thereon, the substrate 31 can be made of a glass substrate, a plastic substrate or other suitable material, and the groove 311 can have an arc-shaped or U-shaped cross section; a plurality of field emitter elements 32 each of which is disposed in one of the grooves 311, the field emitter elements 32 can be made of laminate, bar-shaped or column-shaped conductive material coated with carbon material, and the carbon material can be selected from material such as nanocarbons, diamonds or diamond-like materials, the cathode electrode is made of the laminate, bar-shaped or column-shaped conductive material; a plurality of gate electrodes 33 each of which is disposed between one pair of the adjacent grooves 311, and coupled to a third voltage source, the gate electrodes 33 are used to provide voltage to drive the field emitter elements 32 to inject electrons. As the gate electrodes 33 are closer to the field emitter elements 32, the array of the field emitters 30 can be operated at a lower voltage. That is, the voltage of the third voltage source is lower than the operating voltage of the array of the field emitter 20 of FIG. 2A. The gate electrode 33 is made of a conductive material, such as refractory metal, for example molybdenum, niobium, chromium, hafnium, or their combinations or carbides.

Figure 3B:
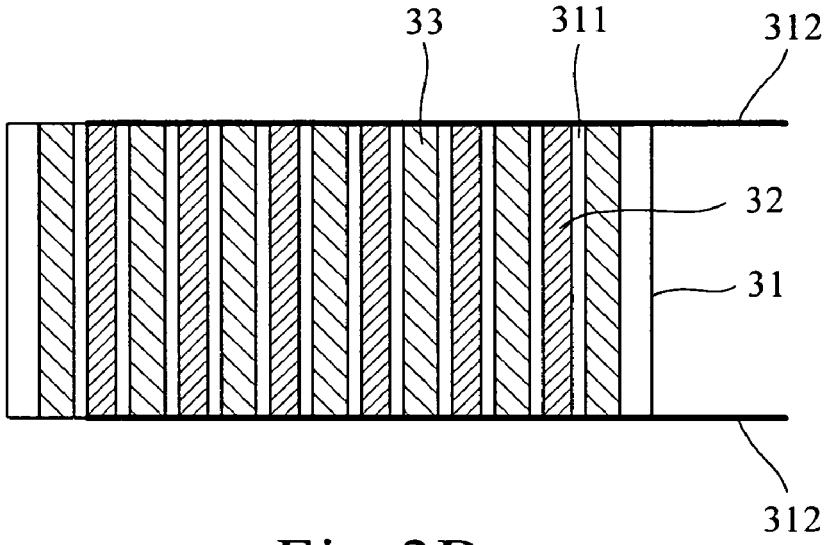
FIG. 3B is a schematic top view of the array of field emitters of FIG. 3A.

FIG. 3B is a schematic top view of the array of field emitters 30. The field emitter elements 32 are serially connected together by electrode lines 312, and then coupled to the first voltage source (not shown). The voltage of the third voltage source is higher than that of the first voltage source.

The process for manufacturing the diode structure of the array of the field emitters 20, shown in FIG. 2A, is easier, but requires a higher operating voltage. The triode structure of the array of field emitters 30, shown in FIG. 3A, facilitates the lowering of operating voltage.

Figure 3C:
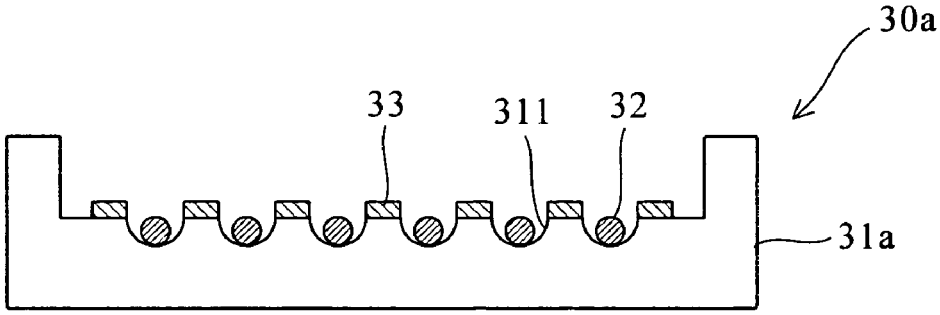
FIG. 3C is a schematic cross-sectional view of a variance of the array of field emitters of FIG. 3A.

FIG. 3C is a schematic cross-sectional view of a variance 30*a* of the array of field emitters 30 of FIG. 3A. The difference between FIG. 3A and FIG. 3C resides in that a substrate 31*a* of FIG. 3C has a U-shaped body formed by a physical etching or chemical etching or a molding method.

Figure 5:
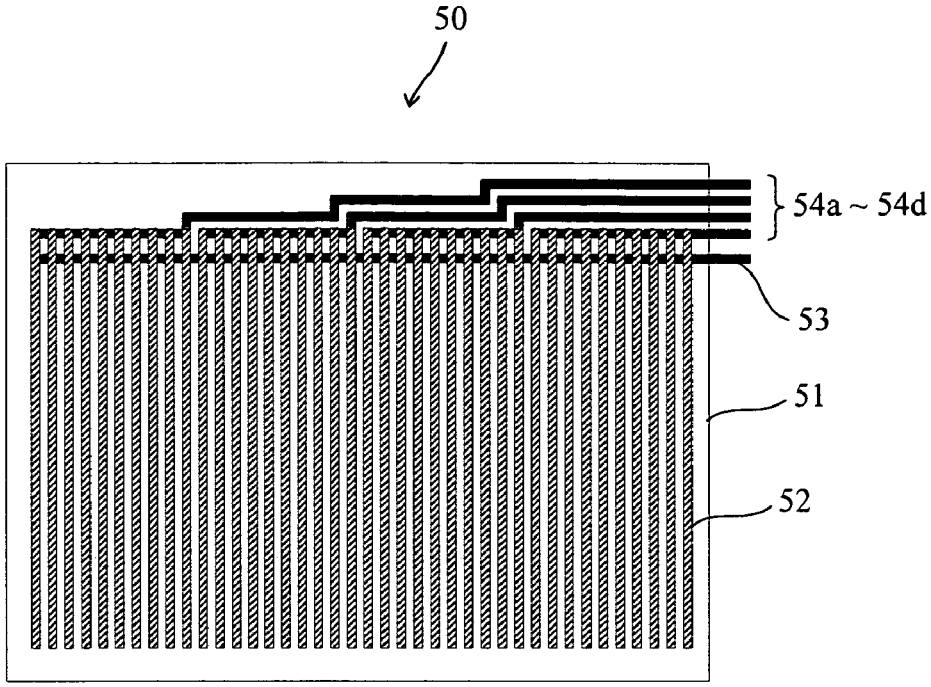
FIG. 5 is a schematic top view of an array of field emitters having auxiliary conductive lines for repair of the present invention.

FIG. 5 is a schematic top view of the array of field emitters 50 according to a third preferred embodiment of the present invention. The array of field emitters 50 is a diode structure with cathode electrodes having auxiliary conductive lines for repair. The array of field emitters 50 includes a substrate 51 and an array of field emitter elements 52. The configuration of the substrate 51 can be as that shown in FIG. 2A and FIG. 2C. The field emitter elements 52 are the same with the field emitter elements 22 of FIG. 2A, and serially connected together by electrode lines 53, and then coupled to the first voltage source. Moreover, the field emitter elements 52 are connected to auxiliary conductive lines 54*a*~54*d* group-by-group. The auxiliary conductive lines 54*a*~54*d* are coupled to the first voltage source for repair purposes. The field emitter elements 52 are serially connected per each group. The auxiliary conductive lines 54*a*~54*d* guarantee the normal operation of the field emitter elements 52 if one part of the electrode line 53 is broken.

In addition, the array of field emitter 50 can be a triode structure (not shown), that is, a gate electrode is formed between each pair of adjacent grooves of the substrate 51.

Figure 6:
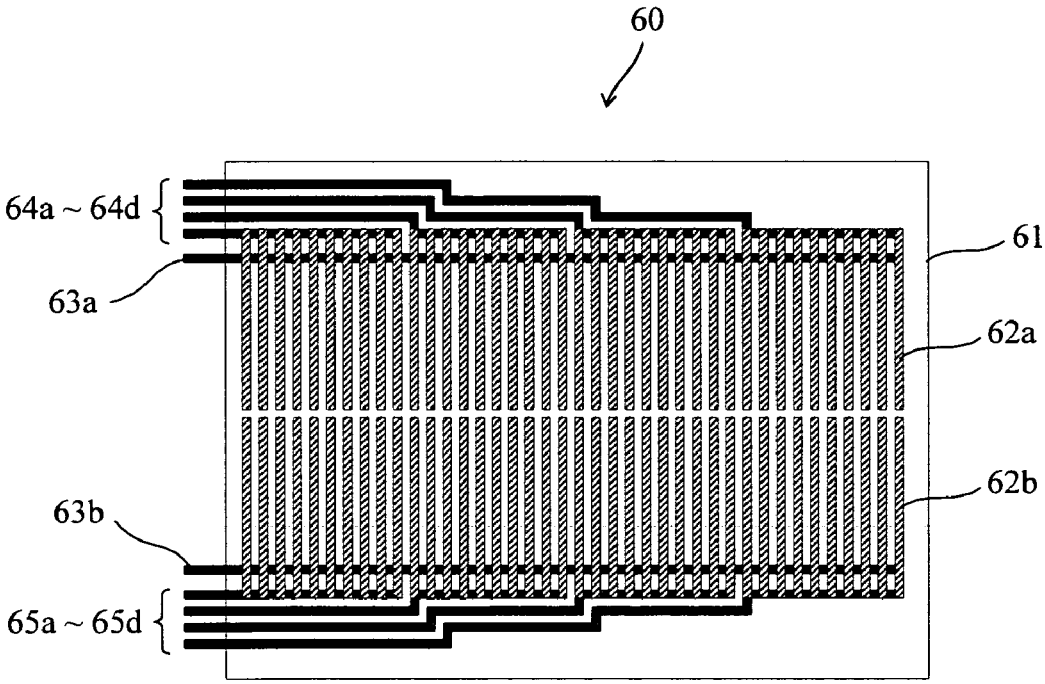
FIG. 6 is a schematic top view of a structure of field emitters in a two-arrayed arrangement having auxiliary conductive lines for repair of the present invention.

FIG. 6 is a schematic top view of the array of field emitters 60 according to a fourth preferred embodiment of the present invention. The array of field emitters 60 is a diode structure with cathode electrodes having auxiliary conductive lines for repair. The array of field emitters 60 includes a substrate 61 and two arrays of parallel-arranged field emitter elements 62*a* and 62*b*. The substrate 61 can have a configuration as that shown in FIG. 2A and FIG. 2C. The field emitter elements 62*a* and 62*b* are the same as the field emitter elements 22 of FIG. 2A, and respectively serially connected by electrode lines 63*a* and 63*b*, and then coupled to the first voltage source. The field emitter elements 62*a* and 62*b* are respectively connected to auxiliary conductive lines 64*a*~64*d* and 65*a*~65*d* group-by-group. The auxiliary conductive lines 64*a*~64*d* and 65*a*~65*d* are coupled to the first voltage source for repair purposes. The auxiliary conductive lines 64*a*~64*d* and 65*a*~65*d* guarantee the normal operation of the field emitter elements 62*a* or 62*b* if one part of the electrode lines 63*a* or 63*b* is broken.

In addition, the array of field emitters 60 can be a triode structure (not shown), that is, a gate electrode is provided between each pair of adjacent grooves of the substrate 61.

Figure 4A:
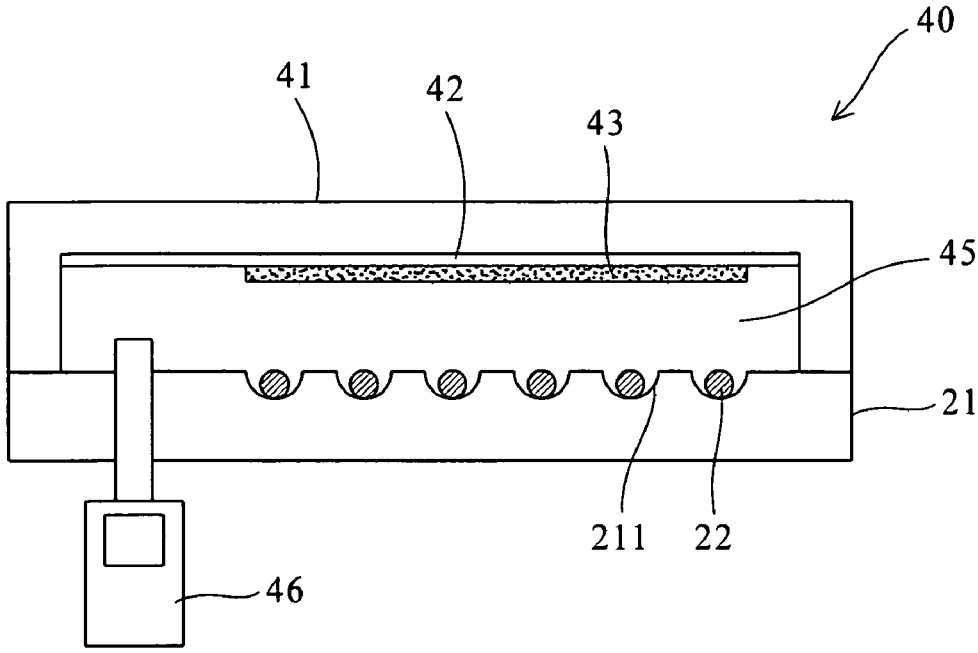
FIG. 4A is a schematic cross-sectional view of an array-like flat lighting source employing the array of field emitters 20 of FIG. 2A.

FIG. 4A is a schematic cross-sectional view of an array-like flat lighting source 40 employing the array of field emitters 20 of FIG. 2A. The array-like flat lighting source 40 includes: the array of field emitters 20 used for cathode emitters; an inverse U-shaped transparent substrate 41, having an upper surface and a lower surface, which can be a glass substrate stacked on the substrate 21 to form a closed space 45 there between; a transparent conductive layer 42 formed on the bottom surface of the transparent substrate 41, the transparent conductive layer 42 is coupled to a second voltage source having a higher voltage than that of the first voltage source, the transparent conductive layer 42 can be made of indium tin oxide (ITO); and an emitting layer 43 formed under the transparent conductive layer 42, the emitting layer 43 can be a fluorescence layer or a phosphorous layer. The field emitter elements 22 inject electrons under attraction of the second voltage source, and impinge upon the emitting layer 43 to cause the emitting layer 43 to emit light passing through the transparent substrate 41 to form a flat lighting source. Since the transparent substrate 41 has an inverse U-shaped configuration, it is not necessary to provide a spacer between the substrate 21 and the transparent substrate 41 to maintain a certain vertical distance there between when packaging the array-like flat lighting source assemblies 40. As a consequence, the packaging process of the present lighting source is easier. Moreover, the substrate 21 and transparent substrate 41 can be made of the same material, such as glass. The same thermal expansion coefficient of both facilitates the maintenance of a vacuum inside the array-like flat lighting source 40. In addition, the substrate 21 can be provided with a getter 46 to communicate with the closed space 45. The getter 46 is used to absorb moisture and other gaseous molecules to improve the vacuum of the closed space 45.

Figure 4B:
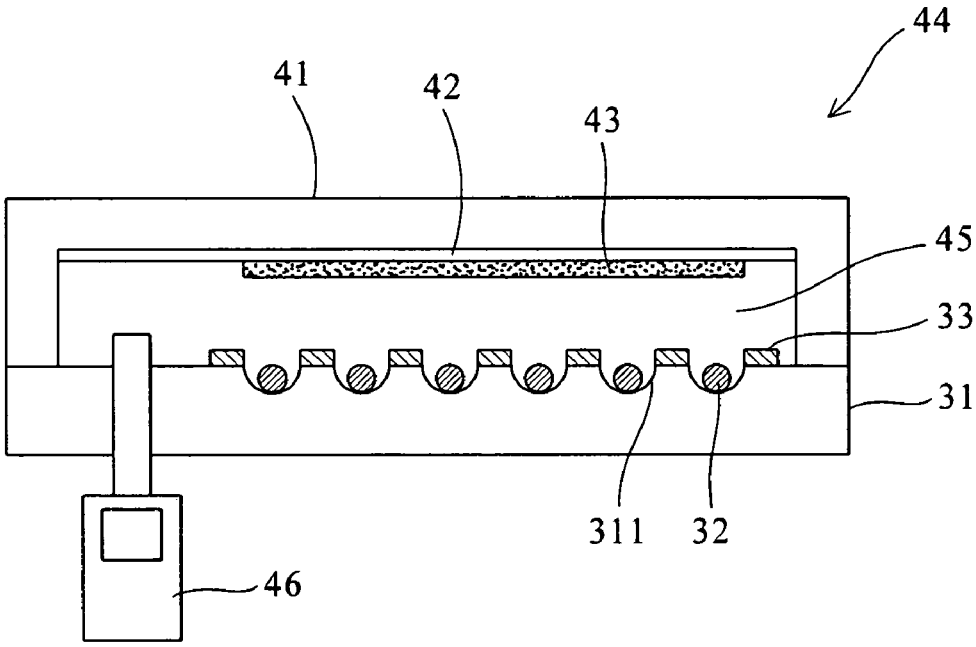
FIG. 4B is a schematic cross-sectional view of an array-like flat lighting source employing the array of field emitters of FIG. 3A.

FIG. 4B is a schematic cross-sectional view of an array-like flat lighting source 42 employing the array of field emitters 30 of FIG. 3A. The difference between FIG. 4B and FIG. 4A resides in that the array of field emitters 30 of FIG. 4B is a triode structure and the gate electrode 33 is coupled to the third voltage source having a higher voltage than that of the first voltage source but lower than that of the second voltage source.

Figure 4C:
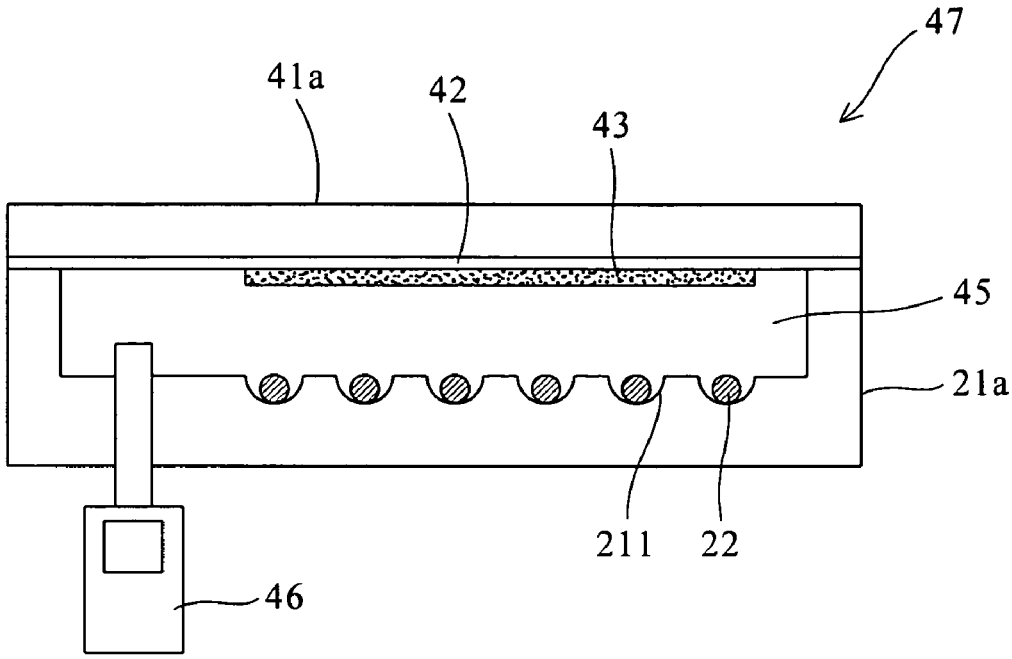
FIG. 4C is a schematic cross-sectional view of an array-like flat lighting source employing the array of field emitters 20*a* of FIG. 2C.

FIG. 4C is a schematic cross-sectional view of an array-like flat lighting source employing the array of field emitters 20*a* of FIG. 2C. The array-like flat lighting source includes: the array of field emitters 20*a* with a U-shaped substrate 21*a*, which is used for cathode emitters; a transparent substrate 41*a*, having an upper surface and a lower surface, for example a glass substrate, stacked on the substrate 21*a* to form a closed space 45 there between; a transparent conductive layer 42 formed on a bottom surface of the transparent substrate 41*a*, the transparent conductive layer 42 is coupled to a second voltage source having a higher voltage than that of the first voltage source, the transparent conductive layer 42 can be made of indium tin oxide (ITO); and an emitting layer 43 formed under the transparent conductive layer 42, the emitting layer 43 can be a fluorescence layer or a phosphorous layer. The field emitter elements 22 inject electrons under attraction of the second voltage source, and impinge upon the emitting layer 43 to cause the emitting layer 43 to emit light passing through the transparent substrate 41*a* to form a flat lighting source. As the substrate 21*a* has a U-shaped configuration, it is not necessary to provide a spacer between the substrate 21*a* and transparent substrate 41*a* to maintain a certain vertical distance there between when packaging the assemblies of the array-like flat lighting source 47. As a consequence, the packaging process of the present lighting source is simplified. Moreover, the substrate 21*a* and the transparent substrate 41*a* can be made of the same material, such as glass. The same thermal expansion coefficient of both of these facilitates the maintenance of the vacuum inside the array-like flat lighting source 44. The substrate 21*a* can be provided with a getter 46 to communicate with the closed space 45. The getter 46 is used to absorb moisture and other gaseous molecules to improve the vacuum of the closed space 45.

Figure 4D:
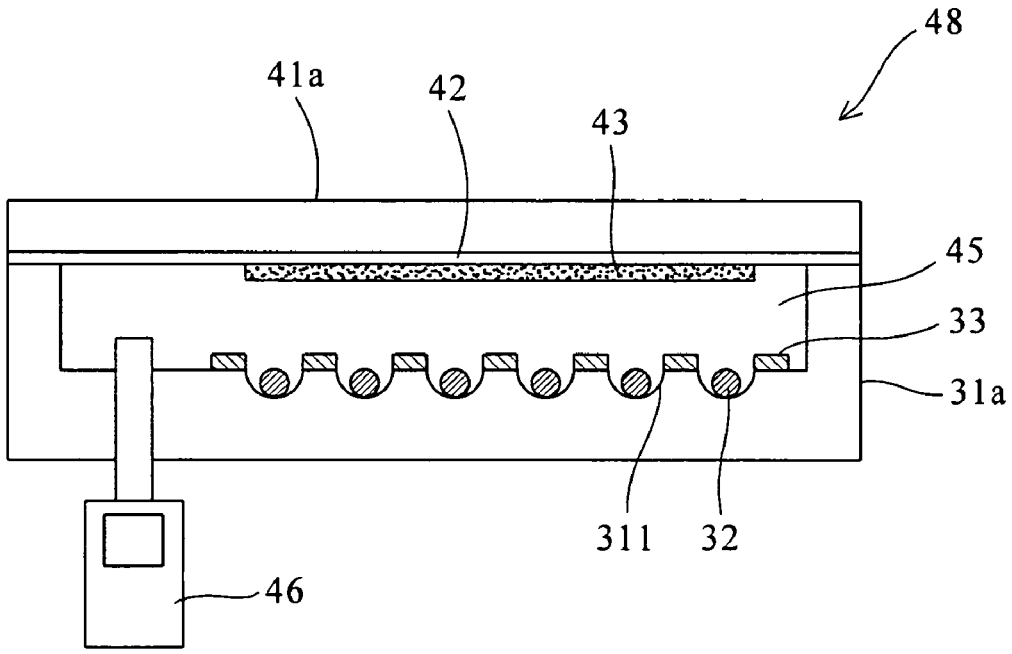
FIG. 4D is a schematic cross-sectional view of an array-like flat lighting source employing the array of field emitters 30*a* of FIG. 3C.

FIG. 4D is a schematic cross-sectional view of an array-like flat lighting source 48 employing the array of field emitters 30*a* of FIG. 3C. The difference between FIG. 4D and FIG. 4C resides in that the array of the field emitters 30*a* of FIG. 4D is a triode structure and the gate electrode 33 is coupled to a third voltage source having a higher voltage than that of the first voltage source but lower than that of the second voltage source.

The present lighting source can meet demands of various illumination applications requiring varying brightness by providing the structure of field emitters in any desired array arrangement.

Besides, the structure of array of field emitters 50 and 60 with auxiliary conductive lines for repair can also be used instead of the array of field emitters 20, 20*a*, 30 and 30*a*. As the array-like flat lighting source has auxiliary conductive lines for repair, which guarantee the normal operation of the cathode field emitters if one part of the electrode lines is broken, both the manufacturing yields of the present lighting source and its operation life are improved.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein.

What is claimed is:

1. An array-like flat lighting source, including:

a bottom substrate having an array of grooves formed thereon;

a plurality of field emitter elements each of which is disposed in one of said grooves, and each said field emitter element is coupled to a first voltage source;

a transparent substrate having a top surface and a bottom surface, said transparent substrate is stacked on said bottom substrate to form a closed space there between;

a transparent conductive layer formed on said bottom surface of said transparent substrate, said transparent conductive layer coupled to a second voltage source having a higher voltage than said first voltage source; and an emitting layer formed under said transparent conductive layer;

wherein a gate electrode is disposed between each pair of adjacent grooves, said gate electrode is coupled to a third voltage source having a higher voltage than said first voltage source but lower than said second voltage source.

2. The array-like flat lighting source of claim 1, wherein said bottom substrate is formed of a U-shaped body.

3. The array-like flat lighting source of claim 1, wherein said transparent substrate is formed of an inverse U-shaped body.

4. The array-like flat lighting source of claim 1, wherein said field emitter element is made of a conductive material coated with a carbon material.

5. The array-like flat lighting source of claim 4, wherein said carbon material is selected from the following: nanocarbons, diamonds or diamond-like material.

6. The array-like flat lighting source of claim 1, wherein said emitting layer is either of a fluorescence layer or a phosphorous layer.

7. The array-like lighting source of claim 1, wherein said field emitter elements are coupled to an auxiliary conductive line group-by-group, said auxiliary conductive line is coupled to said first voltage source and said field emitter elements per each group are serially connected to each other.

8. An array-like flat lighting source, including:

a bottom substrate having an array of grooves formed thereon;

a plurality of field emitter elements each of which is disposed in one of said grooves, and each said field emitter element is coupled to a first voltage source;

a transparent substrate having a top surface and a bottom surface, said transparent substrate is stacked on said bottom substrate to form a closed space there between;

a transparent conductive layer formed on said bottom surface of said transparent substrate, said transparent conductive layer coupled to a second voltage source having a higher voltage than said first voltage source;

an emitting layer formed under said transparent conductive layer; and wherein said transparent substrate is formed of an inverse U-shaped body.

9. A structure of an array of field emitters, comprising:

a U-shaped substrate having an array of grooves formed thereon; and a plurality of field emitter elements each of which is disposed in one of said grooves, and each said field emitter element is coupled to a first voltage source;

wherein a gate electrode is disposed between each pair of said adjacent grooves, said gate electrode is coupled to a second voltage source having a higher voltage than said first voltage source.

10. The structure of an array of field emitter of claim 9, wherein said field emitter element is made of a conductive material coated with a carbon material.

11. The structure of an array of field emitter of claim 9, wherein said carbon material is selected from the following: nanocarbons, diamonds or diamond-like material.

12. The structure of an array of field emitter of claim 9, wherein said field emitter elements are coupled to an auxiliary conductive line respectively group-by-group, said auxiliary conductive line is coupled to said first voltage source and said field emitter elements are serially connected to each other per each group.

* * * * *